US010854998B2

(12) United States Patent
Ito et al.

(10) Patent No.: US 10,854,998 B2
(45) Date of Patent: Dec. 1, 2020

(54) CONNECTION STRUCTURE BETWEEN ELECTRIC WIRE AND TERMINAL, CONNECTION METHOD BETWEEN ELECTRIC WIRE AND TERMINAL, AND TERMINAL

(71) Applicant: Yazaki Corporation, Tokyo (JP)

(72) Inventors: Naoki Ito, Shizuoka (JP); Hironori Kitagawa, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 16/011,821

(22) Filed: Jun. 19, 2018

(65) Prior Publication Data

US 2018/0375225 A1 Dec. 27, 2018

(30) Foreign Application Priority Data

Jun. 26, 2017 (JP) ..... 2017-123899

(51) Int. Cl.
*H01R 4/18* (2006.01)
*H01R 4/62* (2006.01)
(Continued)

(52) U.S. Cl.
CPC ..... *H01R 4/184* (2013.01); *H01R 4/185* (2013.01); *H01R 4/20* (2013.01); *H01R 4/62* (2013.01); *H01R 43/048* (2013.01)

(58) Field of Classification Search
CPC ..... H01R 4/185; H01R 4/188; H01R 43/048; H01R 43/042
(Continued)

(56) References Cited

U.S. PATENT DOCUMENTS 3,767,841 A * 10/1973 Anderson ..... H01R 4/2495 174/840
5,338,233 A * 8/1994 Endo ..... H01R 4/185 439/865
(Continued)

FOREIGN PATENT DOCUMENTS

JP 2005-116241 A 4/2005
JP 2009-123621 A 6/2009

OTHER PUBLICATIONS

Communication dated May 8, 2019, from the Japanese Patent Office in counterpart application No. 2017-123899.

*Primary Examiner* — Hien D Vu
(74) *Attorney, Agent, or Firm* — Sughrue Mion, PLLC

(57) ABSTRACT

A connection structure between an electric wire and a terminal has an electric wire including a core wire with strands, and a terminal including a bottom-plate portion and a pair of core-wire-crimping pieces, which protrude from both edges of the bottom-plate portion and each distal-end portion of the pair of core-wire-crimping pieces being divided into a plurality of portions, the terminal enclosing and holding the core wire by the bottom-plate portion and the pair of core-wire-crimping pieces. The pair of core-wire-crimping pieces extends in directions to approach each other at a proximal-end portion, is in contact with each other at an intermediate portion, and extends in directions to be separated from each other at the distal-end portion. At least one portion of the plurality of portions of each distal-end portion of the pair of core-wire-crimping pieces extend in a different direction from other portions of the distal-end portion.

5 Claims, 9 Drawing Sheets

(51) Int. Cl.
*H01R 4/20* (2006.01)
*H01R 43/048* (2006.01)

(58) Field of Classification Search
USPC ..... 439/877, 878
See application file for complete search history.

(56) References Cited

U.S. PATENT DOCUMENTS 5,399,110 A * 3/1995 Morello ..... H01R 4/185
439/879
5,549,483 A * 8/1996 Hotea ..... H01R 4/185
439/399
5,733,154 A * 3/1998 Libregts ..... H01R 4/182
439/850
6,394,836 B2 * 5/2002 Nagai ..... H01R 12/68
439/422
7,494,388 B2 * 2/2009 Kakuta ..... H01R 4/185
439/877
7,803,008 B2 * 9/2010 Onuma ..... H01R 43/048
439/442
7,896,715 B2 * 3/2011 Kumakura ..... H01R 4/185
439/442
8,721,855 B2 * 5/2014 Nishio ..... G01N 27/4071
204/424
9,039,467 B2 * 5/2015 Seipel ..... H01R 4/185
439/877

* cited by examiner

CONNECTION STRUCTURE BETWEEN ELECTRIC WIRE AND TERMINAL, CONNECTION METHOD BETWEEN ELECTRIC WIRE AND TERMINAL, AND TERMINAL

CROSS REFERENCE TO RELATED APPLICATIONS

This application claims the priority of Japanese Patent Application No. 2017-123899, filed on Jun. 26, 2017, the entire content of which are incorporated herein by reference.

BACKGROUND

Technical Field

The present invention relates to a connection structure between an electric wire and a terminal, a connection method between an electric wire and a terminal, and a terminal used in the connection structure and connection method.

Related Art

Conventionally, a connection structure 301 between an electric wire and a terminal as illustrated in FIGS. 14 to 16 is known.

In the connection structure 301 between the electric wire and the terminal, a core wire (conductor) 309 of an electric wire 307 is held by crimping a core-wire-crimping portion 305 of a terminal 303.

Here, JP 2005-116241 A can be listed as a technical literature relating to the related art.

SUMMARY

Meanwhile, there is a case where the number of the strands 311 constituting the core wire 309 is large in the conventional connection structure 301 between the electric wire and the terminal.

When the number of the strands 311 is large, there are many strands 311 that are not in direct contact with the terminal 303 (the core-wire-crimping portion 305) as illustrated in FIG. 16 at the time of crimping the core-wire-crimping portion 305 to hold the core wire 309. Incidentally, in FIG. 16, the strands 311 with hatching are the strands 311 that are in direct contact with the core-wire-crimping portion 305 to be conducted. Then, the strands 311 without hatching in FIG. 16 are the strands 311 that are not in direct contact with the core-wire-crimping portion 305 and is conducted the core-wire-crimping portion 305 via the strands 311 that are in direct contact with the core-wire-crimping portion 305.

In this manner, when there are many strands 311 that are not in direct contact with the core-wire-crimping portion 305, an electric resistance between the strands 311 adjacent to each other becomes large due to the influence of an oxide film or the like formed on a surface of the strands 311. That is, if there are many strands 311 that are not in direct contact with the core-wire-crimping portion 305, there is a problem that an electrical resistance between the terminal 303 (the core-wire-crimping portion 305) and the core wire 309 increases.

This problem becomes remarkable as the number of strands 311 increases, and also becomes remarkable as the strand 311 is made of aluminum or the like which is likely to form the oxide film on the surface.

The present invention has been made in view of the above-described problem, and an object thereof is to provide a connection structure between an electric wire and a terminal, a connection method between an electric wire and a terminal, and a terminal which are capable of reducing an electric resistance between a core wire of the electric wire and the terminal.

A connection structure between an electric wire and a terminal according to first aspect of the present invention has an electric wire including a core wire with a plurality of strands and a terminal including a bottom-plate portion and a pair of core-wire-crimping pieces, which protrude from both edges of the bottom-plate portion and each distal-end portion of the pair of core-wire-crimping pieces being divided into a plurality of portions, the terminal enclosing and holding the core wire by the bottom-plate portion and the pair of core-wire-crimping pieces. The pair of core-wire-crimping pieces extend in directions to approach each other at a proximal-end portion, are in contact with each other at an intermediate portion, and extend in directions to be separated from each other at the distal-end portion. At least one portion of the plurality of portions of each distal-end portion of the pair of core-wire-crimping pieces extend in a different direction from other portions of the distal-end portion.

The distal-end portion of the core-wire-crimping piece of the terminal may be formed with a plurality of convex portions provided at a predetermined interval in the longitudinal direction of the electric wire, or the distal-end portion of the core-wire-crimping piece may be formed with a plurality of portions delimited by a plurality of slits provided at a predetermined interval in the longitudinal direction of the electric wire.

A terminal according to second aspect of the present invention includes a bottom-plate portion, and a pair of core-wire-crimping pieces protruding from both edges of the bottom-plate portion. At least a part of each distal-end portion of the pair of core-wire-crimping pieces are bent in directions to approach each other.

A terminal according to third aspect of the present invention includes a bottom-plate portion, and a pair of core-wire-crimping pieces protruding from both edges of the bottom-plate portion and having distal-end portions divided into a plurality of portions. At least one portion of the plurality of portions of each distal-end portion of the pair of core-wire-crimping pieces extend in a different direction from other portions of the distal-end portions.

A connection method for connecting an electric wire and a terminal according to fourth aspect of the present invention includes removing a sheath at a part of an electric wire that includes a core wire with a plurality of strands and a sheath covering the core wire. The core wire exposed by removing the sheath are installed onto a core-wire-crimping portion that includes a bottom-plate portion and a pair of core-wire-crimping pieces protruding from both edges of the bottom-plate portion and having distal-end portions divided into a plurality of portions such that at least one portion of the plurality of portions of each distal-end portion extend in a different direction from other portions of the distal-end portion. The core wire is enclosed and held by the bottom-plate portion and the pair of core-wire-crimping pieces such that the pair of core-wire-crimping pieces extend in directions to approach each other at a proximal-end portion, are in contact with each other at an intermediate portion, and extend in directions to be separated from each other at the distal-end portion, and at least one portion of the plurality of portions of each distal-end portion extend in the different direction from the other portions of the distal-end portion, after installing the core wire on the core-wire-crimping portion.

A connection structure between an electric wire and a terminal according to fifth aspect of the present invention has an electric wire including a core wire with a plurality of strands, a terminal including a bottom-plate portion and a pair of core-wire-crimping pieces, which protrude from both edges of the bottom-plate portion and each distal-end portion of the pair of core-wire-crimping pieces being formed with a plurality of convex portions, the terminal enclosing and holding the core wire by the bottom-plate portion and the pair of core-wire-crimping pieces. The pair of core-wire-crimping pieces extends in directions to approach each other at a proximal-end portion and is in contact with each other at an intermediate portion, and the respective convex portions of the distal-end portion extend in directions to be separated from each other.

The aspects of the present invention provides a connection structure between an electric wire and a terminal, a connection method between an electric wire and a terminal, and a terminal which are capable of reducing an electric resistance between a core wire of the electric wire and the terminal.

DETAILED DESCRIPTION

Figure 1:
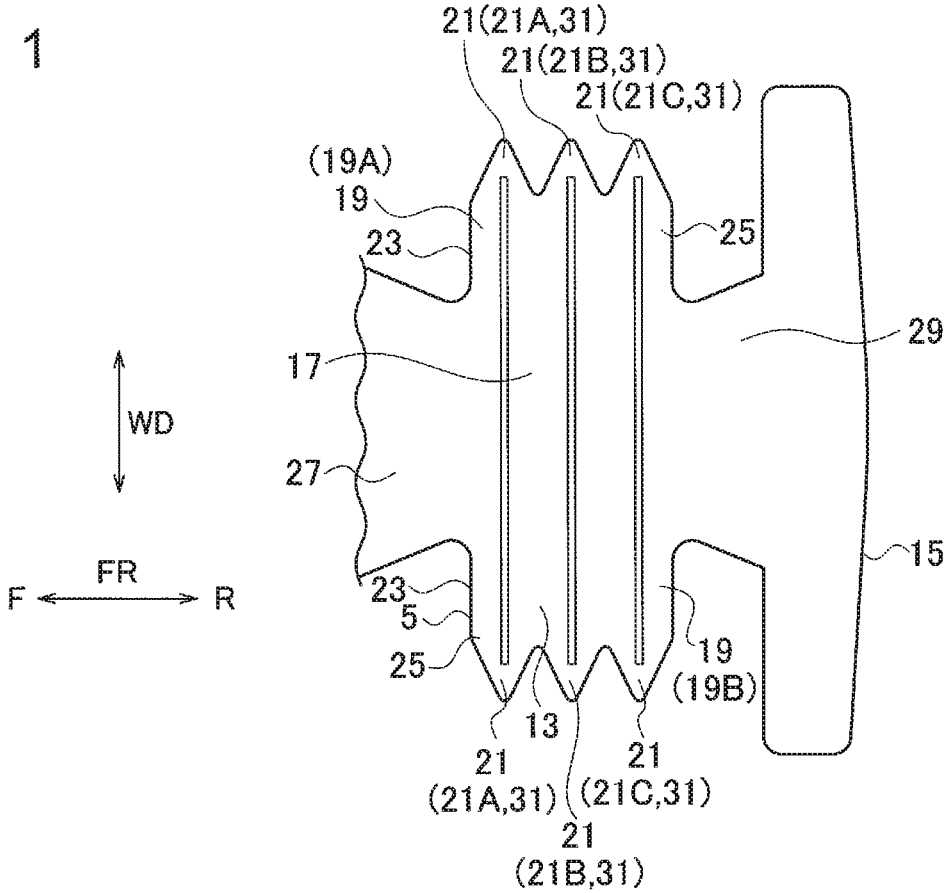
FIG. 1 is a developed view of a terminal used in a connection structure between an electric wire and a terminal according to one embodiment of the present invention.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Description will be hereinbelow provided for embodiments of the present invention by referring to the drawings. It should be noted that the same or similar parts and components throughout the drawings will be denoted by the same or similar reference signs, and that descriptions for such parts and components will be omitted or simplified. In addition, it should be noted that the drawings are schematic and therefore different from the actual ones.

Figure 4:
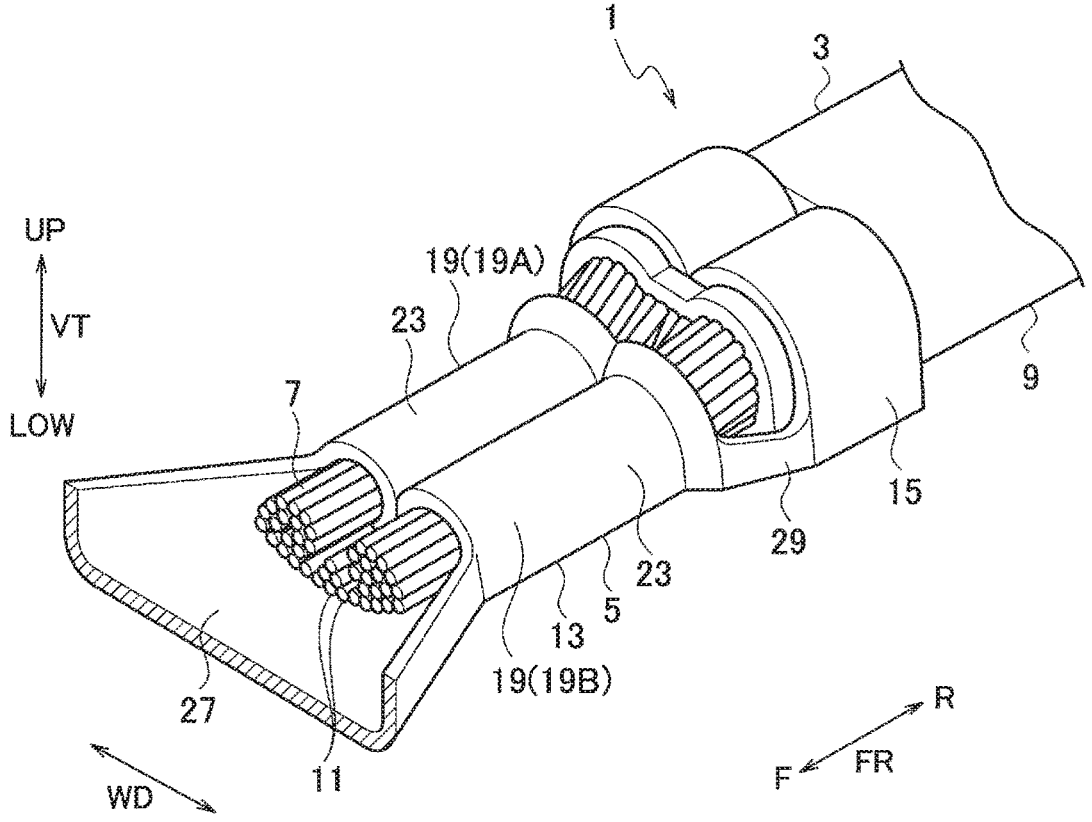
FIG. 4 is a perspective view showing the connection structure between the electric wire and the terminal according to the embodiment of the present invention.
Figure 5:
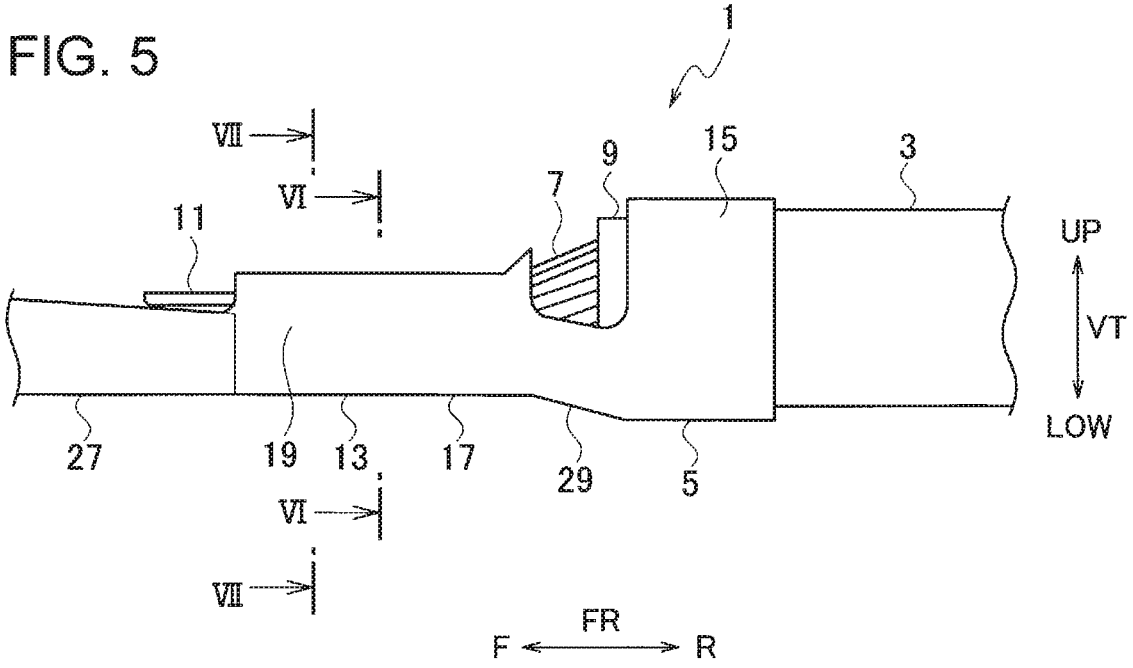
FIG. 5 is a side view showing the connection structure between the electric wire and the terminal according to the embodiment of the present invention.

As illustrated in FIGS. 4 and 5, a connection structure (electric-wire-terminal-connection structure) 1 between an electric wire and a terminal according to an embodiment of the present invention is configured to include an electric wire 3, a terminal (crimp terminal) 5 installed on the electric wire 3. For example, a mating terminal (not illustrated) on which another electric wire (not illustrated) is installed is connected to the terminal 5 used in the electric-wire-terminal-connection structure 1.

For convenience of description, the longitudinal direction of the electric wire 3 and the terminal 5 in the electric-wire-terminal-connection structure 1 is defined as the front-rear direction FR, a predetermined direction orthogonal to the front-rear direction FR is defined as the width direction WD, and a direction orthogonal to the front-rear direction FR and the width direction WD is defined as the vertical direction VT (height direction). Moreover, with respect to the vertical direction VT specified in FIG. 3 and the like, the side on which a bottom-plate portion 17, to be described later, is disposed is referred to as the lower side LOW, and the side on which core-wire-crimping pieces 19, to be described later, are disposed is referred to as the upper side UP.

In addition, when a plane that passes through the center of the electric-wire-terminal-connection structure 1 and is orthogonal to the width direction WD is assumed as a central plane, the electric wire 3 and the terminal 5 of the electric-wire-terminal-connection structure 1 are formed to be symmetric with respect to this central plane, that is, to be bilaterally symmetric.

The electric wire 3 is configured to include a core wire (conductor) 7 and a sheath (sheath having insulation properties) 9 covering the core wire 7. The core wire 7 is constituted by a plurality of strands 11. The strand 11 is formed to be elongated, for example, in a columnar shape using metal such as aluminum and copper or an alloy thereof.

In the electric wire 3, a part (for example, one end in the longitudinal direction; a front end in the front-rear direction FR) of the sheath 9 is removed to expose the core wire 7.

The plurality of strands 11 are collected in a bundle in the form of being twisted or being linearly extended and bundled, thereby constituting the core wire 7. The core wire 7 (the electric wire 3) has flexibility. A cross section (a cross section taken along a plane orthogonal to the longitudinal direction) of a portion of the electric wire 3 from which the sheath 9 has not been removed is, for example, a circular shape.

More specifically, the cross section of the core wire 7 formed by gathering the strands 11 substantially without gaps is formed in a substantially circular shape. The sheath 9 covering the core wire 7 with a predetermined thickness is formed in an annular shape having a predetermined width and the entire outer circumference of the circular core wire 7 is in contact with the entire inner circular circumference of the sheath 9. In addition, in the state of only the electric wire 3 on which the terminal 5 or the like is not installed, the strands 11 adjacent to each other are not fixed but are in a state of being just in contact with each other.

Figure 2:
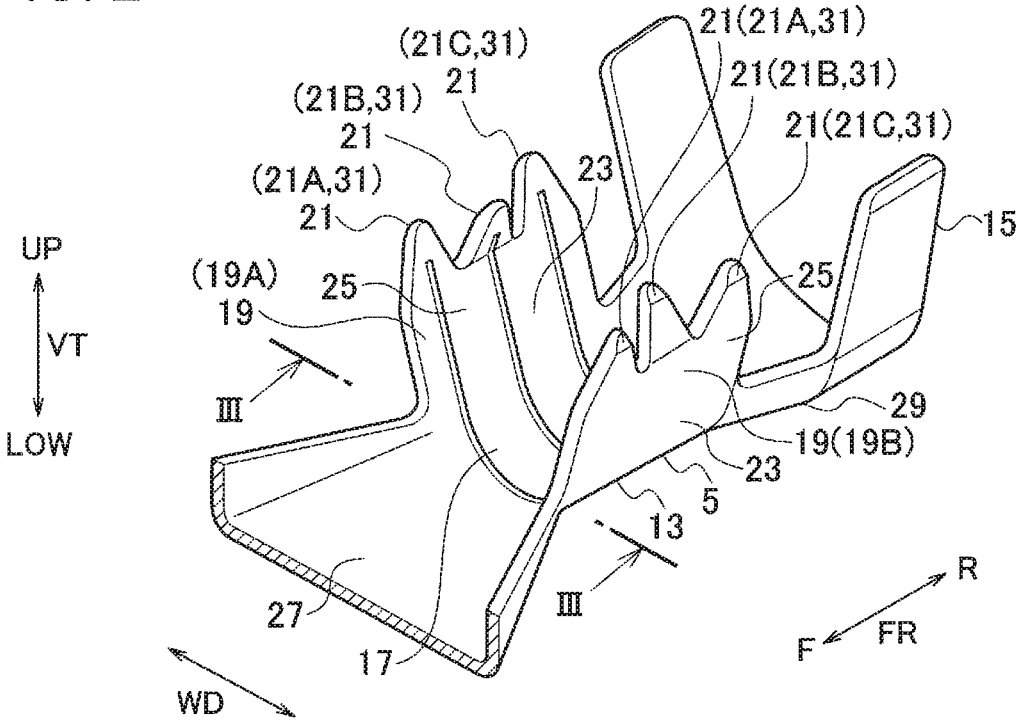
FIG. 2 is a perspective view of the terminal used in the connection structure between the electric wire and the terminal according to the embodiment of the present invention, the view showing a state before the terminal is installed to the electric wire.

The terminal 5 is formed, for example, by forming a flat plate-shaped metallic material into a predetermined shape (see FIG. 1) and appropriately bending the material into this predetermined shape (see FIG. 2). In addition, the terminal 5 is configured to include a core-wire-crimping portion (a core wire connecting portion; a core wire installing portion) 13, a sheath-crimping portion (sheath installing portion) 15, and a mating terminal connecting portion (not illustrated). In the terminal 5, the mating terminal connecting portion, the core-wire-crimping portion 13, and the sheath-crimping portion 15 are arranged in this order from the front side F to the rear side R in the front-rear direction FR.

Furthermore, a first joining portion 27 is provided between the mating terminal connecting portion and the core-wire-crimping portion 13 as illustrated in FIG. 2 and the like. Further, a second joining portion 29 is provided between the core-wire-crimping portion 13 and the sheath-crimping portion 15.

Figure 3:
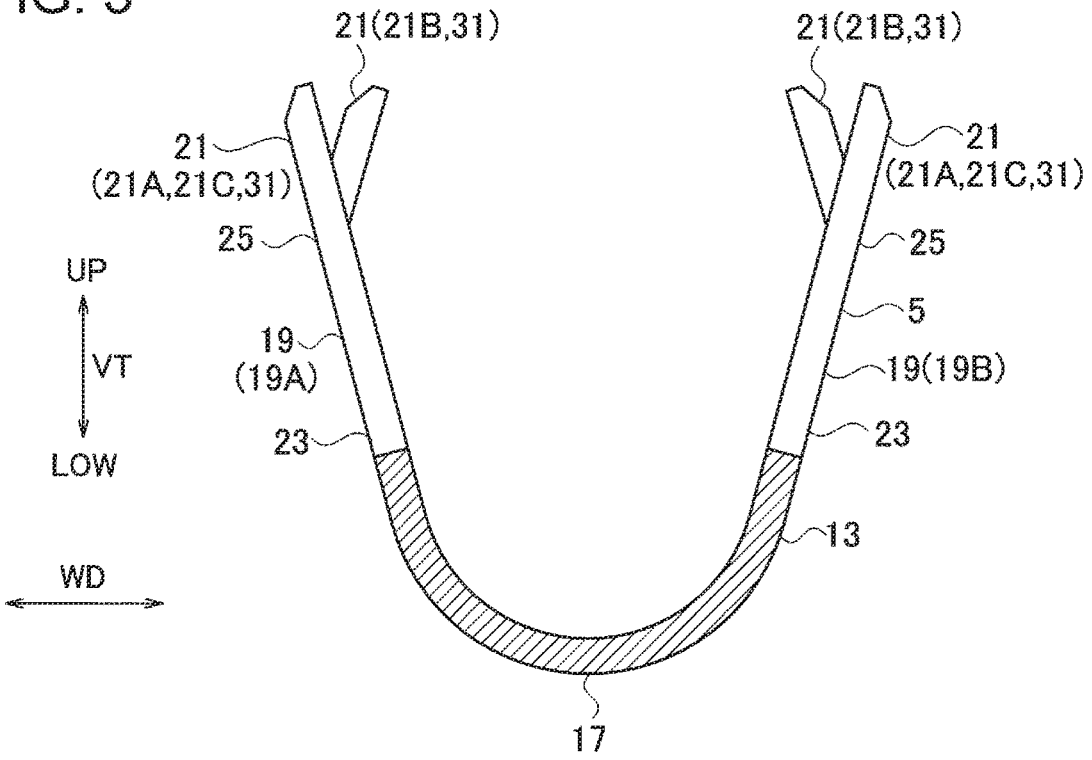
FIG. 3 is a cross-sectional view cut along III-III of FIG. 2.
Figure 6:
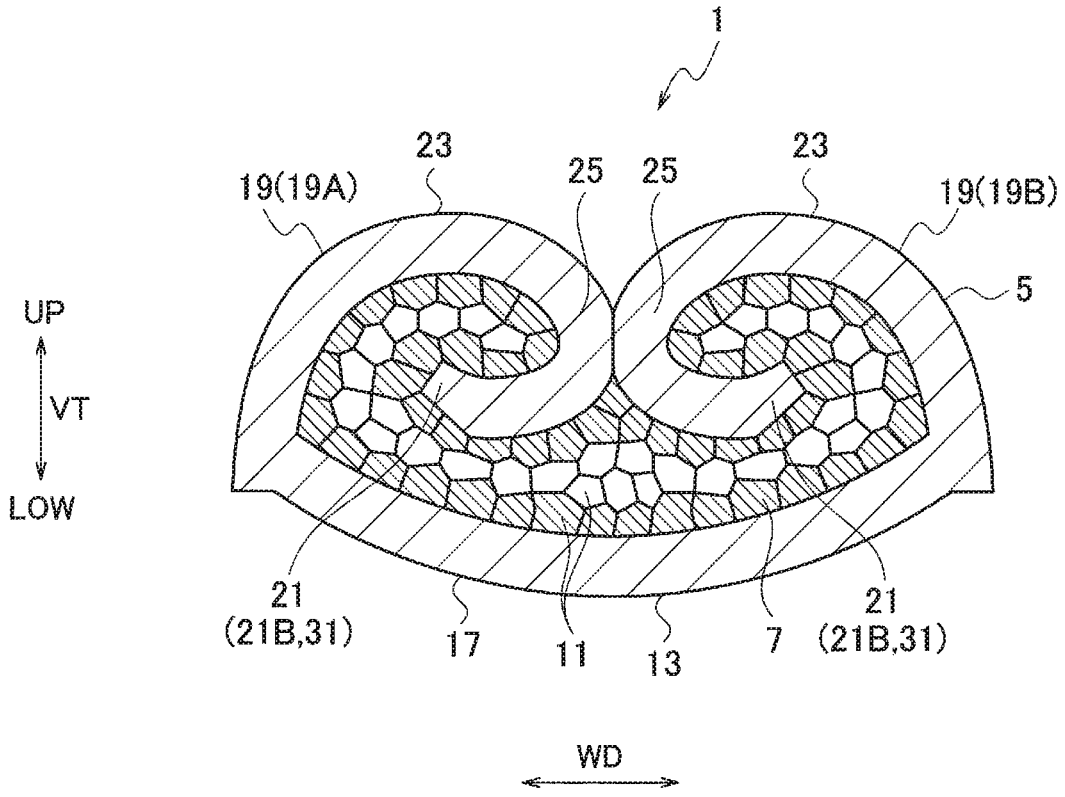
FIG. 6 is a cross-sectional view cut along VI-VI of FIG. 5.
Figure 7:
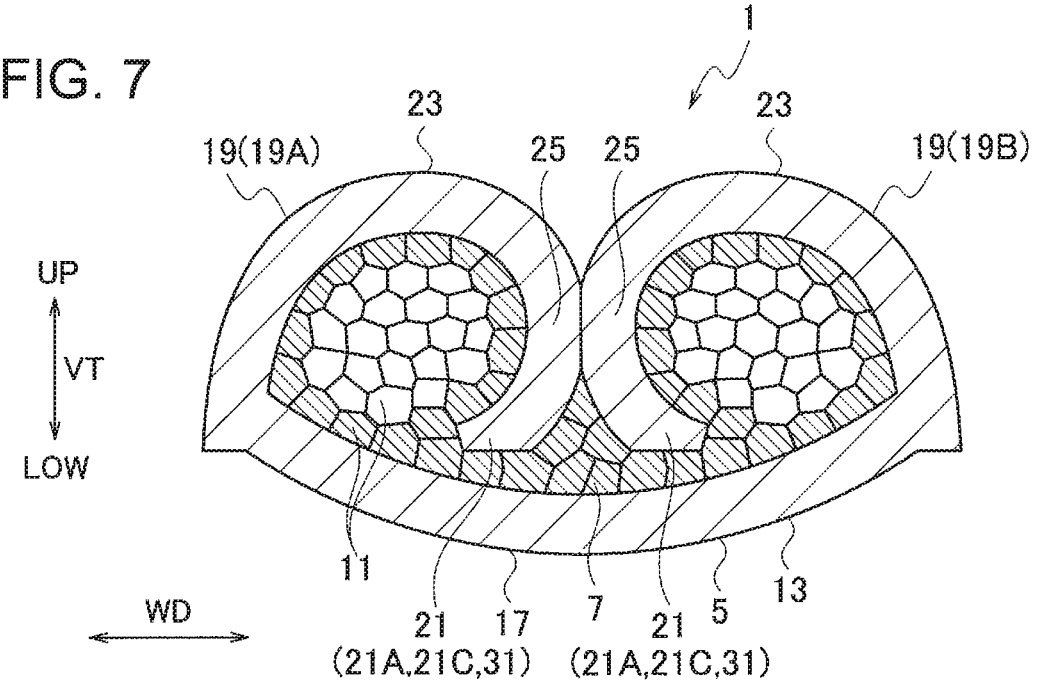
FIG. 7 is a cross-sectional view cut along VII-VII of FIG. 5.
Figure 8:
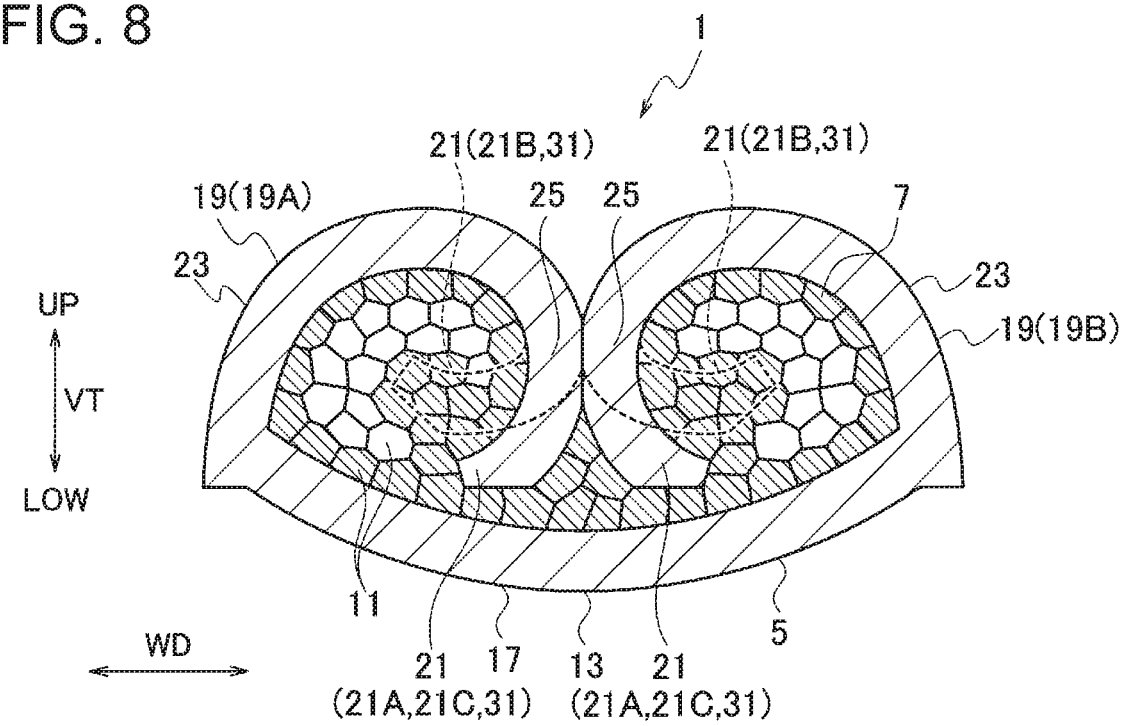
FIG. 8 is a view in which broken lines indicating the distal-end portion of the cored wire crimping piece shown in FIG. 6 are added to FIG. 7.

As illustrated in FIGS. 2 and 3, the core-wire-crimping portion 13 is configured to include the bottom-plate portion 17 and a pair of core-wire-crimping pieces 19 protruding from both edges of the bottom-plate portion 17. As illustrated in FIGS. 6 to 8, the core-wire-crimping portion 13 encloses and holds the core wire 7 by the bottom-plate portion 17 and the pair of core-wire-crimping pieces 19 in the crimped state of the pair of core-wire-crimping pieces 19 and the bottom-plate portion 17.

Each of the pair of core-wire-crimping pieces 19 is configured to include a distal-end portion (a portion distant from the bottom-plate portion 17) 21, a proximal-end portion (a portion on the bottom-plate portion 17) 23, and an intermediate portion (a portion between the distal-end portion 21 and the proximal-end portion 23) 25. The distal-end portion 21 is divided into a plurality of portions 21A, 21B, and 21C in the front-rear direction FR (see FIGS. 1, 2, and the like)

Here, a state where the core-wire-crimping portion 13 holds the core wire 7 is assumed as a core-wire-holding state of core-wire-crimping portion. As illustrated in FIGS. 6 to 8, the bottom-plate portion 17 extends in the width direction WD so that the thickness direction becomes the vertical direction VT when the core-wire-holding state of core-wire-crimping portion is viewed in the front-rear direction FR.

Each of the pair of core-wire-crimping pieces 19 extends in directions (inward directions in the width direction WD) to approach each other at the proximal-end portion 23 when the core-wire-holding state of core-wire-crimping portion is viewed in the front-rear direction FR. Each of the pair of core-wire-crimping pieces 19 is in contact with each other at a predetermined location on the central plane in the intermediate portion 25, for example, with a biasing force when the core-wire-holding state of core-wire-crimping portion is viewed in the front-rear direction FR. In addition, each of the pair of core-wire-crimping pieces 19 extends in directions (directions to be separated from the central plane or the intermediate portion 25 in the width direction WD) to be separated from each other at the distal-end portion 21 when the core-wire-holding state of core-wire-crimping portion is viewed in the front-rear direction FR.

Furthermore, in order to increase the number of the strands 11 in direct contact with the terminal 5, at least the portion 21B as a part of the distal-end portion 21 of the core-wire-crimping piece 19 extends in a different direction from the other portions 21A and 21C of the distal-end portion 21 (see FIG. 8) when the core-wire-holding state of core-wire-crimping portion is viewed in the front-rear direction FR.

Incidentally, the sheath 9 of the electric wire 3 is held by the sheath-crimping portion 15 by crimping the sheath-crimping portion 15.

Here, the core-wire-crimping portion 13 before being crimpled will be described in detail.

First, a state where the flat plate-shaped material is formed into the predetermined shape but is not yet subjected to bending will be described. In the state illustrated in FIG. 1, the flat plate-shaped material formed in the predetermined shape is viewed in the thickness direction.

The bottom-plate portion 17, the proximal-end portions 23 of the pair of core-wire-crimping pieces 19, and the intermediate portions 25 of the pair of core-wire-crimping pieces 19 have rectangular shapes.

In addition, a through hole is not formed in the core-wire-crimping portion 13 (including the distal-end portion 21) which is configured to include the bottom-plate portion 17 and the pair of core-wire-crimping pieces 19. Thus, considering from the viewpoint of topological geometry, the core-wire-crimping portion 13 can be regarded as the same as a sphere when the shape of the core-wire-crimping portion 13 is continuously changed.

As illustrated in FIGS. 1, 2, and the like, the distal-end portion 21 of the core-wire-crimping piece 19 of the terminal 5 is formed with a plurality of convex portions (protrusions) provided at predetermined intervals in the longitudinal direction of the electric wire 3.

In other words, the distal-end portion 21 of each of the core-wire-crimping pieces 19 (19A and 19B) is divided into the plurality of portions in the front-rear direction FR. More specifically, as illustrated in FIG. 1, the distal-end portion 21 of the core-wire-crimping piece 19 is formed in a triangular wave shape running in the front-rear direction FR, that is, formed in a jagged shape, thereby being formed with, for example, the three triangular convex portions 31. At this time, a distal end of the distal-end portion 21 is pointed.

As illustrated in FIGS. 1 to 3, the core-wire-crimping portion 13 of the terminal 5 is configured to include the bottom-plate portion 17 and the pair of core-wire-crimping pieces 19 (19A and 19B) protruding from both edges of the bottom-plate portion 17 in the width direction WD. The pair of core-wire-crimping pieces 19 (19A and 19B) are bent in the directions (inward) to approach each other at least in the portions 21B of these distal-end portions 21.

More specifically, as illustrated in FIG. 3, the bottom-plate portion 17 extends in the width direction WD such that the thickness direction becomes the substantially vertical direction VT, and has an arc shape protruding downward when the core-wire-crimping portion 13 is viewed in the front-rear direction FR.

The proximal-end portion 23, the intermediate portion 25, and the portions 21A and 21C of the distal-end portion 21 of the core-wire-crimping piece 19A are linearly erected obliquely upward from one end of the bottom-plate portion 17. The proximal-end portion 23, the intermediate portion 25, and the portions 21A and 21C of the distal-end portion 21 of the core-wire-crimping piece 19B are also linearly erected obliquely upward from the other end of the bottom-plate portion 17. Incidentally, a distance in the width direction WD between the core-wire-crimping piece 19A (excluding the portion 21B) and the core-wire-crimping piece 19B (excluding the portion 21B) gradually increases from bottom to top.

The portion 21B of the distal-end portion 21 of the core-wire-crimping piece 19A is erected obliquely upward from the distal end (upper end) of the intermediate portion 25 of the core-wire-crimping piece 19A. The portion 21B of the distal-end portion 21 of the core-wire-crimping piece 19B is also erected obliquely upward from the distal end (upper end) of the intermediate portion 25 of the core-wire-crimping piece 19B. Incidentally, a distance in the width direction WD between the portion 21B of the distal-end portion 21 of the core-wire-crimping piece 19A and the portion 21B of the distal-end portion 21 of the core-wire-crimping piece 19B gradually decreases from bottom to top.

Next, the core-wire-holding state of core-wire-crimping portion will be described in detail.

As illustrated in FIGS. 6 to 8, the bottom-plate portion 17 extends in the width direction WD such that the thickness direction becomes the substantially vertical direction VT, and has the arc shape protruding downward when the core-wire-crimping portion 13 in the core-wire-holding state of core-wire-crimping portion is viewed in the front-rear direction FR.

The proximal-end portion 23 of one of the core-wire-crimping pieces (left core-wire-crimping piece) 19A extends from one end (left end) in the width direction WD of the bottom-plate portion 17 to the upper right direction and then to the lower right direction. That is, the proximal-end portion 23 protrudes in an are shape such as a semicircular shape protruding upward by a first predetermined amount in the right direction.

The intermediate portion 25 of the one core-wire-crimping piece 19A protrudes downward slightly by a second predetermined amount from the distal end of the proximal-end portion 23 of the core-wire-crimping piece 19A.

The portion 21B of the distal-end portion 21 of the core-wire-crimping piece 19A protrudes from the distal end of the intermediate portion 25 of the core-wire-crimping piece 19A, by a third predetermined amount, in the left direction to be an arc shape such as a quarter arc shape as illustrated in FIGS. 6 and 8.

The portions 21A and 21C of the distal-end portion 21 of the core-wire-crimping piece 19A protrudes from the distal end of the intermediate portion 25 of the core-wire-crimping piece 19A, by a third predetermined amount, in the lower left direction to be an arc shape such as a quarter arc shape as illustrated in FIGS. 7 and 8.

In addition, since the core-wire-crimping portion 13 is formed to be symmetric with respect to the central plane, the proximal-end portion 23, the intermediate portion 25 and the distal-end portion 21 of the other core-wire-crimping piece (right core-wire-crimping piece) 19B also protrude similarly to the proximal-end portion 23, the intermediate portion 25, and the distal-end portion 21 of the one core-wire-crimping piece 19A.

In addition, since the distal-end portions 21 of the core-wire-crimping pieces 19 protrude in the directions to be separated from each other, and the following configuration is obtained.

The distal-end portion 21 of the one core-wire-crimping piece 19A (the other core-wire-crimping piece 19B) is not in contact with the proximal-end portion 23 and the bottom-plate portion 17 of the one core-wire-crimping piece 19A (the other core-wire-crimping piece 19B) and protrudes between the proximal-end portion 23 and the bottom-plate portion 17 of the one core-wire-crimping piece 19A (the other core-wire-crimping piece 19B).

As a result, the portion 21B as a part of the distal-end portion 21 of the one core-wire-crimping piece 19A (the other core-wire-crimping piece 19B) extends in a different direction from the other portions 21A and 21C of the distal-end portion 21.

Incidentally, a value of the first predetermined amount described above is larger than a value of the third predetermined amount, for example, the value of the first predetermined amount may be about three times of the value of the third predetermined amount. A value of the second predetermined amount is small. Therefore, the pair of core-wire-crimping pieces 19 is in contact with each other in the form of being close to line contact in the intermediate portion 25.

In addition, a length of the core wire 7 exposed after the removal of the sheath 9 is slightly longer than a length of the core-wire-crimping portion 13 in the front-rear direction FR. In the core-wire-holding state of core-wire-crimping portion, the core wire 7 slightly protrudes from a front end of the core-wire-crimping portion 13, and the core wire 7 also slightly protrudes from a rear end of the core-wire-crimping portion 13. A portion on a further rearward side of the core wire 7 slightly protruding at the rear end is covered with the sheath 9, and this portion of the sheath 9 is held by the sheath-crimping portion 15.

In addition, a tubular portion is formed by the bottom-plate portion 17, and the proximal-end portion 23 and the intermediate portion 25 of the core-wire-crimping piece 19 in the core-wire-holding state of core-wire-crimping portion. Further, the tubular portion surrounds all of the strands 11, that is, the entire circumference of the core wire 7 with a biasing force. The distal-end portion 21 of the core-wire-crimping piece 19 is inserted among the strands 11 by wading through the strands 11 inside the tubular portion with a biasing force.

Next, a connection method between the electric wire 3 and the terminal 5 will be described.

First, the sheath 9 is removed such that the core wire 7 is exposed over a predetermined length at a part of the electric wire 3, for example, at one end portion in the longitudinal direction (a sheath removal step).

Subsequently, the core wire 7 exposed by removing the sheath 9 in the sheath removal step is installed onto the core-wire-crimping portion 13 (a core wire/terminal installation step).

Simultaneously with the core wire/terminal installation step, a portion of the sheath 9 of the electric wire 3 in the vicinity of the exposed core wire 7 is installed onto the sheath-crimping portion 15 of the terminal 5 (a sheath/terminal installation step).

After the core wire 7 is installed onto the core-wire-crimping portion 13 in the core wire/terminal installation step, the core-wire-crimping portion 13 is crimped, and the core wire 7 is enclosed and held by the bottom-plate portion 17 and the pair of core-wire-crimping pieces 19 (a core wire holding step).

As a result, the strands 11 with hatching are brought into direct contact with the core-wire-crimping portion 13 as illustrated in FIGS. 6 to 8.

Simultaneously with the core wire holding step, the sheath-crimping portion 15 is also crimped so that the sheath 9 is held by the sheath-crimping portion 15.

According to the electric-wire-terminal-connection structure 1, at least the portion 21B as a part of the distal-end portion 21 of the core-wire-crimping piece 19 extends in a different direction from the other portions 21A and 21C of the distal-end portion 21 of the core-wire-crimping piece 19. Thus, the number of the strands 11 of the core wire 7 in direct contact with the core-wire-crimping portion 13 of the terminal 5 increases, and the number of the strands 11 of the core wire 7 not in direct contact with the core-wire-crimping portion 13 decreases. As a result, an electric resistance between the core wire 7 of the electric wire 3 and the terminal 5 can be reduced, and the electric resistance (at a press-fitting portion) between the core wire 7 and the core-wire-crimping portion 13 is stabilized.

In particular, when the strand 11 is made of aluminum or an alloy thereof which is likely to form an oxide film on its surface, the oxide film on the surface of the strand 11 that is in direct contact with the core-wire-crimping portion 13 is destroyed by crimping of the core-wire-crimping portion 13. Then, the core-wire-crimping portion 13 and the strand 11 without the oxide film are in direct contact with each other, and thus, it is possible to reduce the value of the electric resistance between the core wire 7 of the electric wire 3 and the terminal 5.

In addition, the through hole is not formed in the core-wire-crimping portion 13 including the distal-end portion 21 according to the electric-wire-terminal-connection structure 1. As a result, the rigidity of the terminal 5 does not decrease, and the increase in the electric resistance caused by the decrease in rigidity is suppressed.

In addition, since the core-wire-crimping portion 13 is formed in the tubular shape to cover the entire outer circumference of the core wire 7 of the electric wire 3 according to the electric-wire-terminal-connection structure 1, the core wire 7 is not exposed in the core-wire-crimping portion 13. As a result, the rigidity of the terminal 5 (particularly the rigidity of the core-wire-crimping portion 13) does not decrease, and the increase in the electric resistance caused by the decrease in rigidity is suppressed.

In addition, the distal-end portion 21 of the core-wire-crimping piece 19 of the terminal 5 is formed with the plurality of convex portions 31 (21A, 21B, and 21C) provided at predetermined intervals in the longitudinal direction of the electric wire 3 according to the electric-wire-terminal-connection structure 1. As a result, when the core wire 7 is held by crimping the core-wire-crimping portion 13, the distal-end portion 21 of the core-wire-crimping piece 19 is easily inserted inside the core wire 7 (between the large number of strands 11) while wading through the strands 11 without significantly damaging the strands 11.

In addition, in the terminal 5 before the electric wire 3 is installed, the pair of core-wire-crimping pieces 19 is bent in the directions (inward) to approach each other at the distal-end portions 21 thereof according to the electric-wire-terminal-connection structure 1. As a result, it is unnecessary to form an elongated groove for facilitating the bending at a boundary between the distal-end portion 21 and the intermediate portion 25 of the core-wire-crimping piece 19 when crimping the core-wire-crimping portion 13 to install the terminal 5 on the electric wire 3.

Then, the distal-end portion 21 of the core-wire-crimping piece 19 is inserted between the strands 11 of the core wire 7 when crimping the core-wire-crimping portion 13 to install the terminal 5 on the electric wire 3, and the contact area between the terminal 5 and the core wire 7 increases, whereby the electric resistance between the terminal 5 and the core wire 7 can be reduced.

Figure 9:
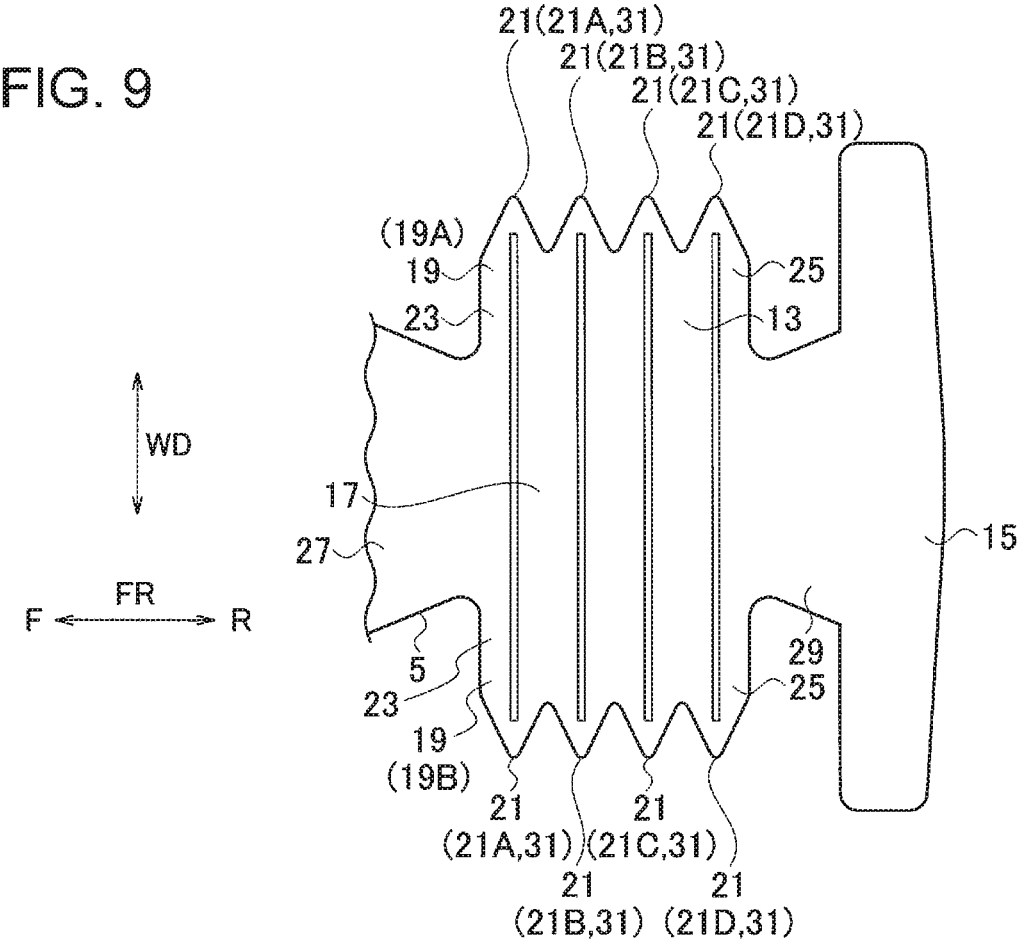
FIG. 9 is a developed view of a terminal according to a variation, the view that corresponds to FIG. 1.

Meanwhile, the distal-end portion 21 of the core-wire-crimping piece 19 is divided into the three portions 21A, 21B, and 21C in the above description, but the distal-end portion 21 of the core-wire-crimping piece 19 may be divided into four portions 21A, 21B, 21C, and 21D as illustrated in FIG. 9 or may be divided into five or more portions.

Figure 10:
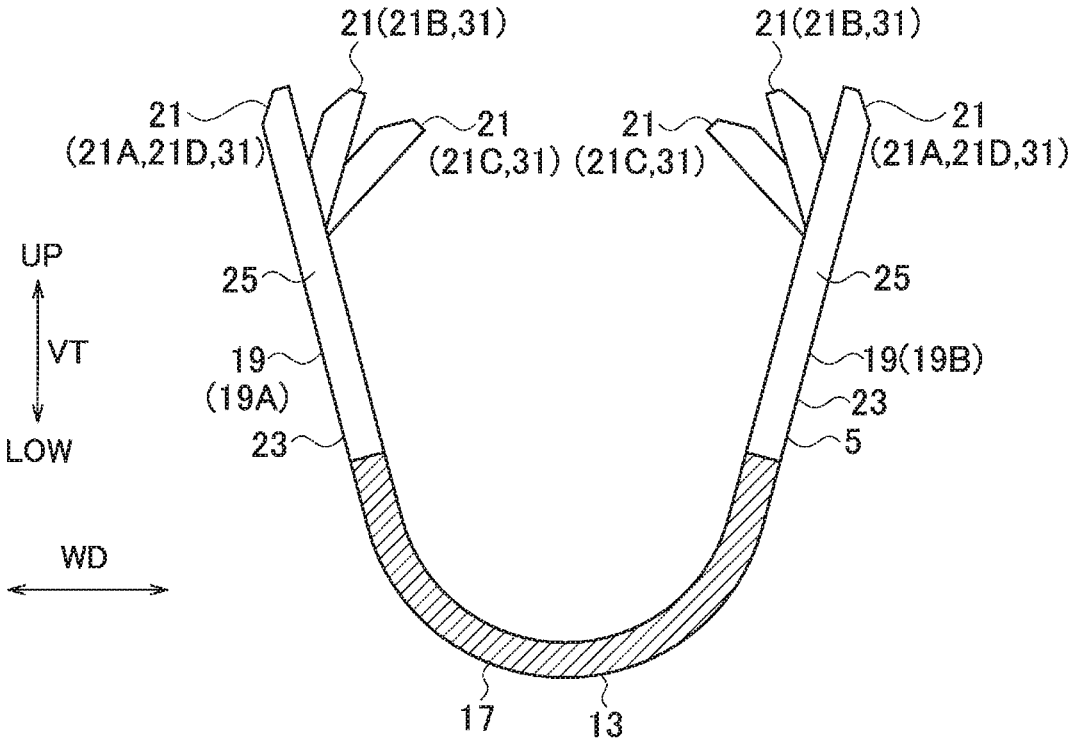
FIG. 10 is view of a terminal according to the variation, the view that corresponds to FIG. 3.

In this case, it is desirable that bending angles of the respective portions 21A, 21B, 21C, and 21D be changed as illustrated in FIG. 10.

Figure 11:
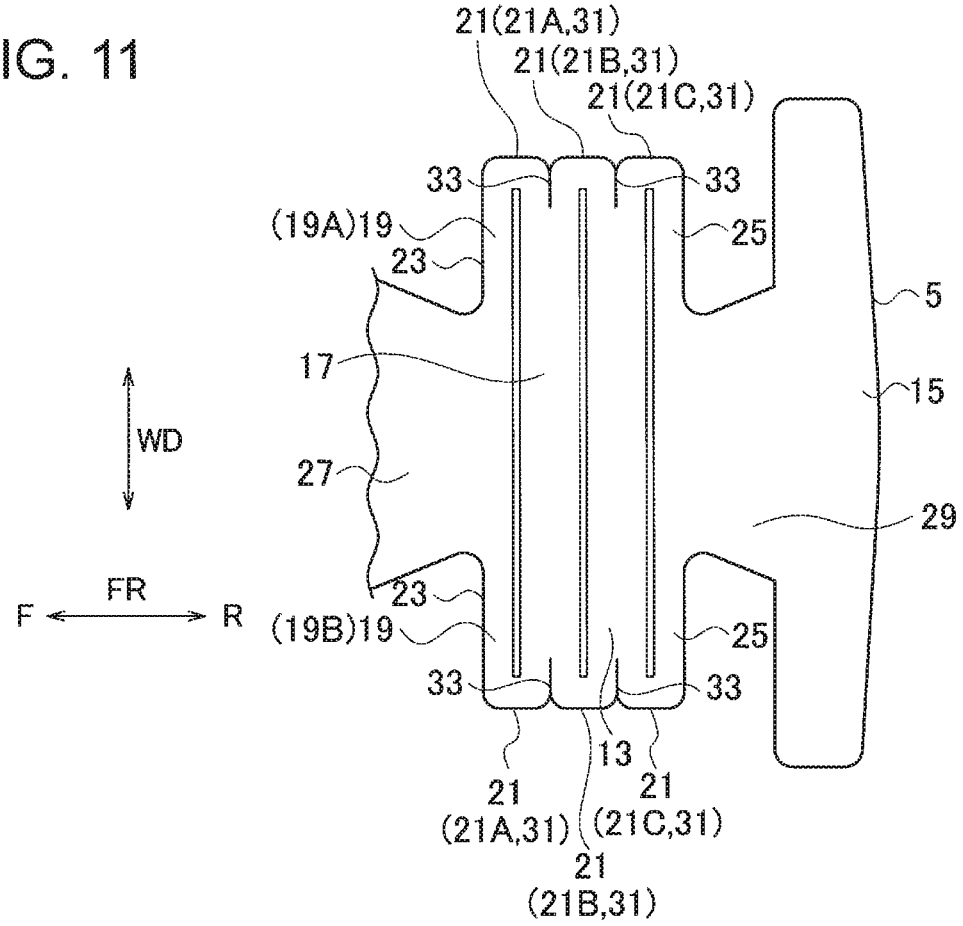
FIG. 11 is a developed view of a terminal according to another variation, the view that corresponds to FIG. 1.

In addition, the distal-end portion 21 of the core-wire-crimping piece 19 is formed in the pointed shape in the triangular shape in the above description. However, the distal-end portion 21 of the core-wire-crimping piece 19 may be formed with a plurality of portions 21A, 21B, and 21C delimited by a plurality of slits 33 provided at predetermined intervals in the front-rear direction FR as illustrated in FIG. 11.

Figure 12:
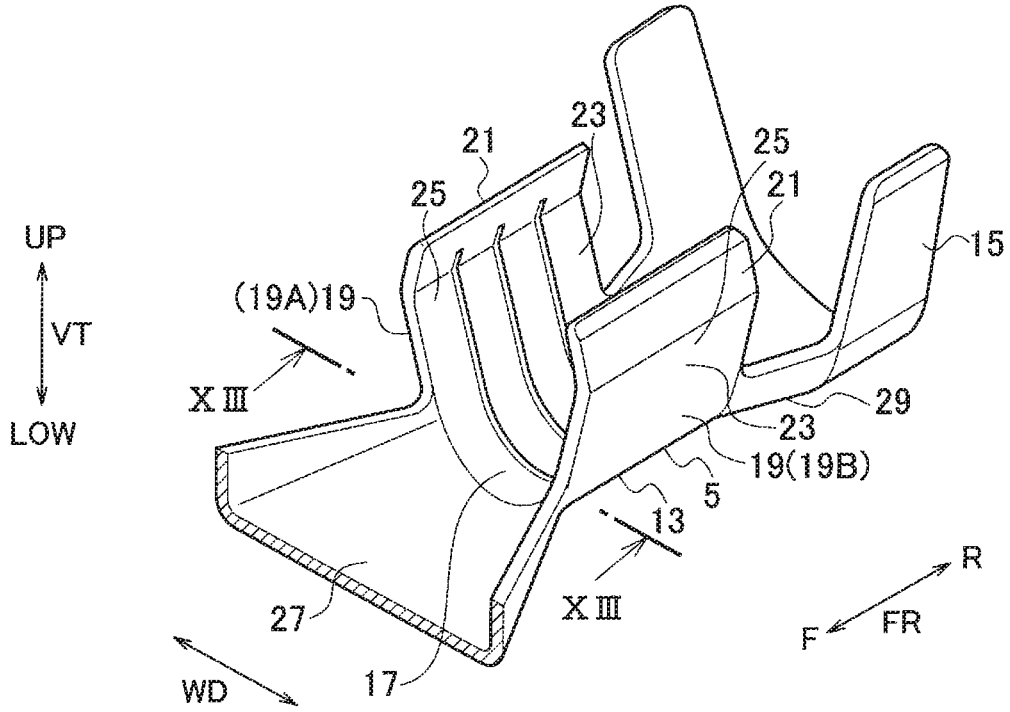
FIG. 12 is a perspective view of a terminal used in a connection structure between an electric wire and a terminal according to still another variation, the view showing a state before the terminal is installed to the electric wire.
Figure 13:
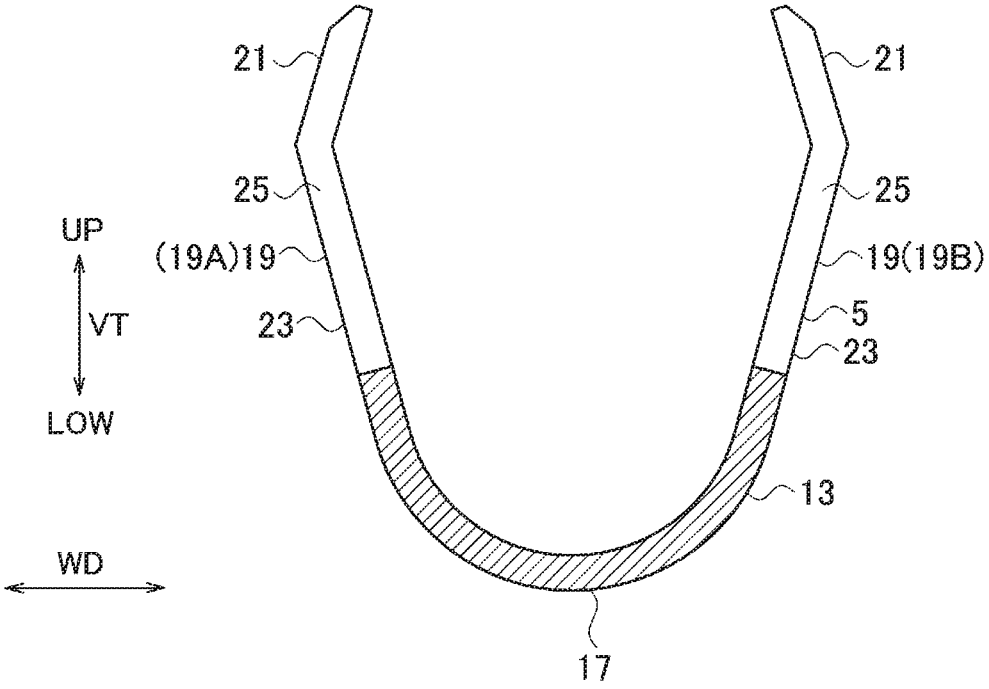
FIG. 13 is a cross-sectional view cut along XIII-XIII of FIG. 12.
Figure 14:
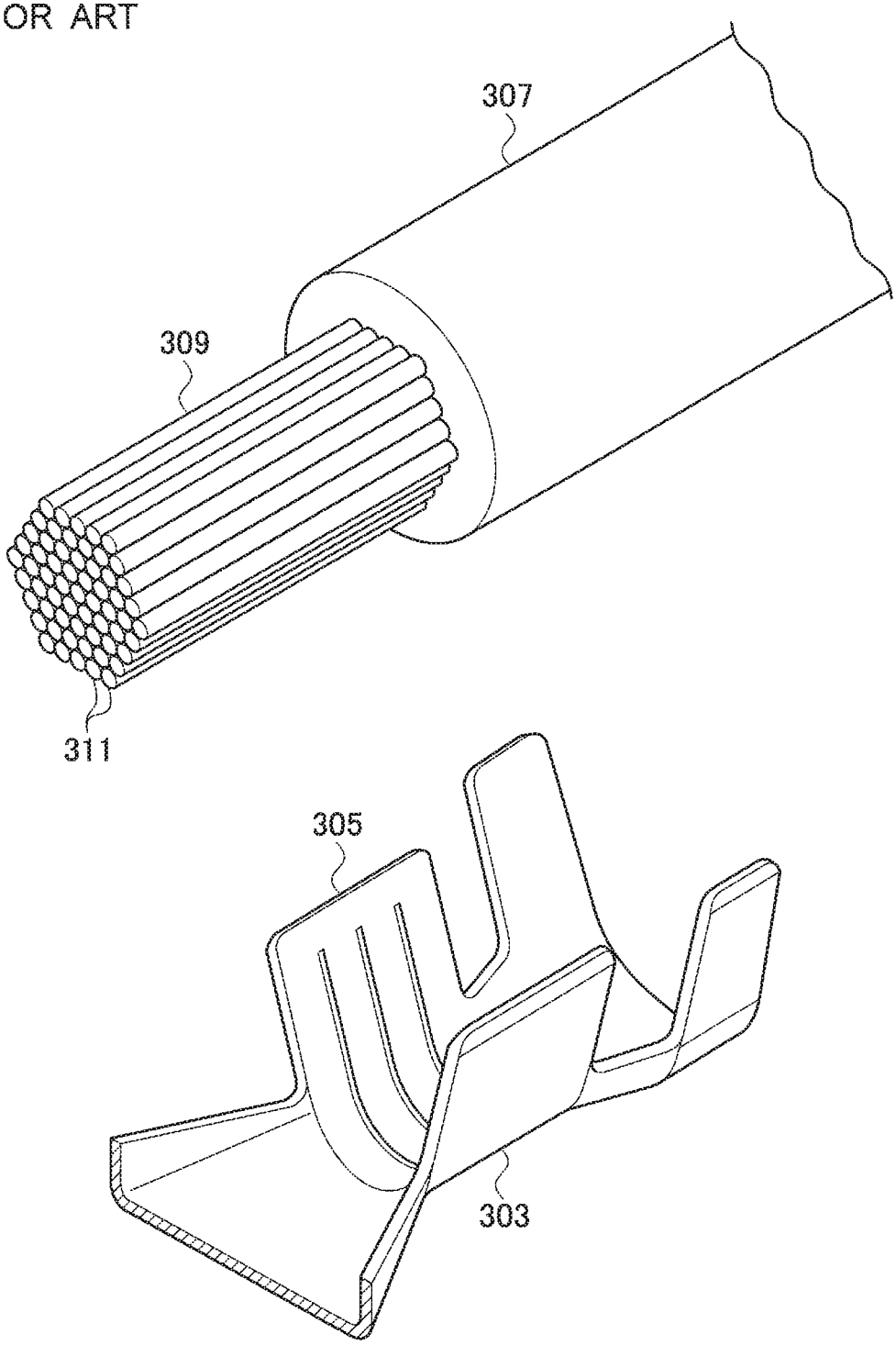
FIG. 14 PRIOR ART
FIG. 14 is a perspective view of a state before the terminal is installed to the electric wire in a conventional connection structure between an electric wire and a terminal.
Figure 15:
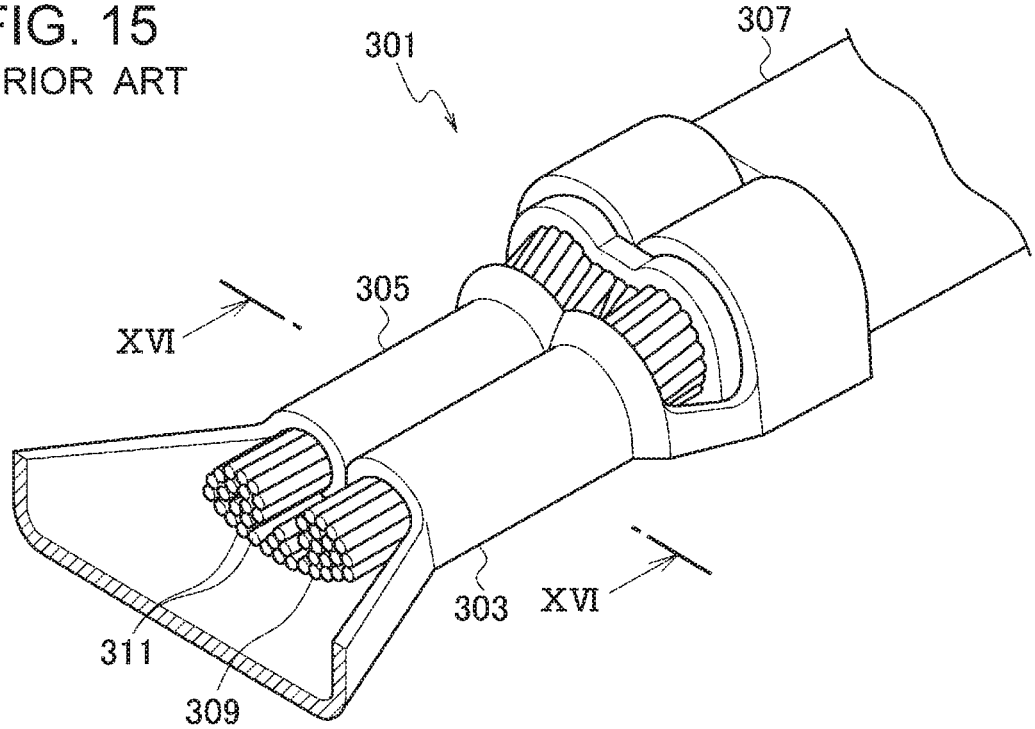
FIG. 15 PRIOR ART
FIG. 15 is a perspective view showing the conventional connection structure between the electric wire and the terminal.
Figure 16:
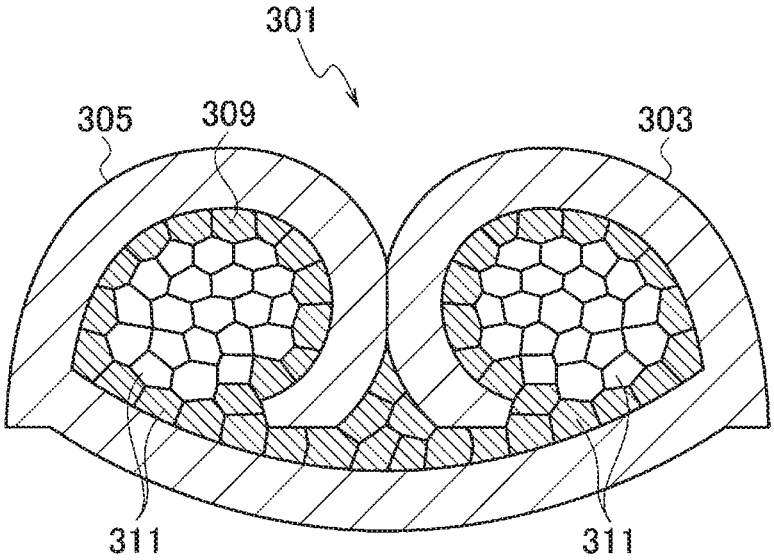
FIG. 16 PRIOR ART
FIG. 16 is a cross-sectional view cut along XVI-XVI of FIG. 15.

In addition, the distal-end portion 21 of the core-wire-crimping piece 19 may be configured not to be divided into a plurality of portions as illustrated in FIGS. 12 and 13. In this case, when the core-wire-crimping portion 13 is developed, the bottom-plate portion 17 and the pair of core-wire-crimping pieces 19 (the proximal-end portion 23, the intermediate portion 25, and the distal-end portion 21) have rectangular flat plate shape.

In addition, in the state before the core-wire-crimping portion 13 of the terminal 5 illustrated in FIGS. 12 and 13 is crimped, the distal-end portions 21 (the entire distal-end portion 21) of each of the pair of core-wire-crimping pieces 19 are bent inward in the width direction WD similarly to the portion 21B of the distal-end portion 21 illustrated in FIG. 3.

Meanwhile, the terminal 5 is installed at the end of the electric wire 3 in the longitudinal direction in the above description, but a terminal may be installed on the core wire 7, exposed by removing the sheath 9, over a predetermined length in an intermediate portion of the electric wire 3 in the longitudinal direction. Incidentally, the terminal in this case has a shape different from that of the terminal 5, but is the terminal provided with the core-wire-crimping portion 13.

In addition, the portions (21A, 21B, and 21C) of the distal-end portion 21 of the core-wire-crimping piece 19 extend in different directions in the above description. However, all the portions of the distal-end portion 21 of the one core-wire-crimping piece 19A may extend in the same direction, or all the portions of the distal-end portion 21 of the other core-wire-crimping piece 19B may extend in the same direction.

That is, an electric-wire-terminal-connection structure may be configured to include: an electric wire including a core wire constituted by a plurality of strands; a terminal including a bottom-plate portion and a pair of core-wire-crimping pieces, which protrude from both edges of the bottom-plate portion and have distal-end portions each of which is constituted by a plurality of convex portions, the terminal enclosing and holding the core wire by the bottom-plate portion and the pair of core-wire-crimping pieces such that the pair of core-wire-crimping pieces extend in directions to approach each other at a proximal-end portion and are in contact with each other at an intermediate portion, and the respective convex portions of the distal-end portion extend in directions to be separated from each other.

Embodiments of the present invention have been described above. However, the invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

Moreover, the effects described in the embodiments of the present invention are only a list of optimum effects achieved by the present invention. Hence, the effects of the present invention are not limited to those described in the embodiment of the present invention.

What is claimed is:

1. An electrical connection structure for connecting an electric wire and a terminal, the electrical connection structure comprising:

an electric wire including a core wire, the core wire having a plurality of strands; and a terminal including a bottom-plate portion and a pair of core-wire-crimping pieces, which protrude from both edges of the bottom-plate portion, and each distal-end portion of the pair of core-wire-crimping pieces is divided into a plurality of portions, the terminal enclosing and holding the core wire by the bottom-plate portion and the pair of core-wire-crimping pieces, wherein the pair of core-wire-crimping pieces extend in directions to approach each other at proximal-end portions, are in contact with each other at intermediate portions, and extend in directions to be separated from each other at the distal-end portions, and at least one portion of the plurality of portions of each distal-end portion of each core-wire crimping piece of the pair of core-wire-crimping pieces extends in a different direction from other portions of each distal-end portion of each core-wire crimping piece of the pair of core-wire-crimping pieces in bending directions.

2. The electrical connection structure for connecting an electric wire and a terminal according to claim 1, wherein each distal-end portion of the pair of core-wire-crimping pieces of the terminal is formed with a plurality of convex portions provided at a predetermined interval in the longitudinal direction of the electric wire, or each distal-end portion of the core-wire-crimping pieces is formed with a plurality of portions delimited by a plurality of slits provided at a predetermined interval in the longitudinal direction of the electric wire.

3. A terminal comprising:

a bottom-plate portion; and a pair of core-wire-crimping pieces protruding from both edges of the bottom-plate portion and each of the pair of core-wire crimping pieces having a distal-end portion divided into multiple parts individually separated in a longitudinal direction of the terminal, each of the pair of core-wire-crimping pieces standing in a height direction of the terminal from the bottom-plate portion, wherein a first part included in the multiple parts of each distal-end portion of each core wire crimping piece of the pair of core-wire-crimping pieces extends in a different direction from a second part included in the multiple parts of each distal-end portions of each core wire crimping piece of the pair of core-wire-crimping pieces, wherein a distance, in the width direction of the terminal, between the first part and the second part gradually changes toward a distal end side in the height direction of the terminal.

4. An electrical connection method for connecting an electric wire and a terminal, the electrical connection method comprising:

removing a sheath at a part of an electric wire that includes a core wire having a plurality of strands and a sheath covering the core wire;

installing the core wire exposed by removing the sheath onto a core-wire-crimping portion that includes a bottom-plate portion and a pair of core-wire-crimping pieces protruding from both edges of the bottom-plate portion and each of the pair of core-wire crimping pieces having distal-end portions divided into a plurality of portions such that at least one portion of the plurality of portions of each distal-end portion of each core-wire crimping piece of the pair of core-wire-crimping pieces extends in a different direction from other portions of the distal-end portion in bending directions of each core-wire crimping piece of the pair of core-wire-crimping pieces; and enclosing and holding the core wire by the bottom-plate portion and the pair of core-wire-crimping pieces such that the pair of core-wire-crimping pieces extend in directions to approach each other at a proximal-end portion, are in contact with each other at an intermediate portion, and extend in directions to be separated from each other at the distal-end portion, and at least one portion of the plurality of portions of each distal-end portion extend in the different direction from the other portions of the distal-end portion, after installing the core wire on the core-wire-crimping portion.

5. An electrical connection structure for connecting an electric wire and a terminal, the electrical connection structure comprising:

an electric wire including a core wire, the core wire having a plurality of strands;

a terminal including a bottom-plate portion and a pair of core-wire-crimping pieces, which protrude from both edges of the bottom-plate portion and each distal-end portion of the pair of core-wire-crimping pieces being formed with a plurality of convex portions, the terminal enclosing and holding the core wire by the bottom-plate portion and the pair of core-wire-crimping pieces, wherein the pair of core-wire-crimping pieces extends in directions to approach each other at a proximal-end portion and is in contact with each other at an intermediate portion, and the respective convex portions of the distal-end portion extend in directions to be separated from each other, and at least one convex portion of the plurality of convex portions of each distal-end portion of each core wire crimping piece of the pair of core-wire-crimping pieces extends in a different direction from other convex portions of the plurality of convex portions of each distal-end portion of each core wire crimping piece in bending directions of the pair of core-wire-crimping pieces.

* * * * *